United States Patent [19]

Cardone

[11] 3,936,300

[45] Feb. 3, 1976

[54] GLUCOSIDE HUMECTANT AS SILVER HALIDE EMULSION STABILIZER

[75] Inventor: Paul A. Cardone, Framingham, Mass.

[73] Assignee: Polaroid Corporation, Cambridge, Mass.

[22] Filed: Aug. 30, 1974

[21] Appl. No.: 502,160

Related U.S. Application Data

[63] Continuation-in-part of Ser. No. 303,008, Nov. 2, 1972, abandoned.

[52] U.S. Cl. ..... 96/29 D; 96/3; 96/73; 96/74; 96/76 R; 96/77; 96/99; 96/100; 96/109

[51] Int. Cl.[2] .. G03C 5/54; G03C 7/00; G03C 1/40; G03C 1/34

[58] Field of Search ..... 96/77, 3, 76 R, 29 D, 99, 96/100, 109, 74, 114.3, 114.4, 114.5, 73

[56] References Cited

UNITED STATES PATENTS

| | | | |
|---|---|---|---|
| 3,034,894 | 5/1962 | Jeffreys et al. | 96/114.3 |
| 3,063,838 | 11/1962 | Jennings | 96/114.3 |
| 3,185,569 | 5/1965 | Weber et al. | 96/114.3 |
| 3,721,555 | 3/1973 | Becker et al. | 96/3 |

FOREIGN PATENTS OR APPLICATIONS

| | | | |
|---|---|---|---|
| 231,185 | 7/1957 | Australia | 96/29 D |
| 554,212 | 7/1957 | Belgium | 96/29 D |

*Primary Examiner*—David Klein
*Assistant Examiner*—Richard L. Schilling
*Attorney, Agent, or Firm*—Mart C. Matthews; Philip G. Kiely

[57] ABSTRACT

The present invention is directed to novel photographic products for use in color diffusion transfer systems wherein at least one of the layers of the film unit contains an amount of a glucoside humectant effective to stabilize the silver halide emulsion(s) thereof against fog during storage.

12 Claims, 1 Drawing Figure

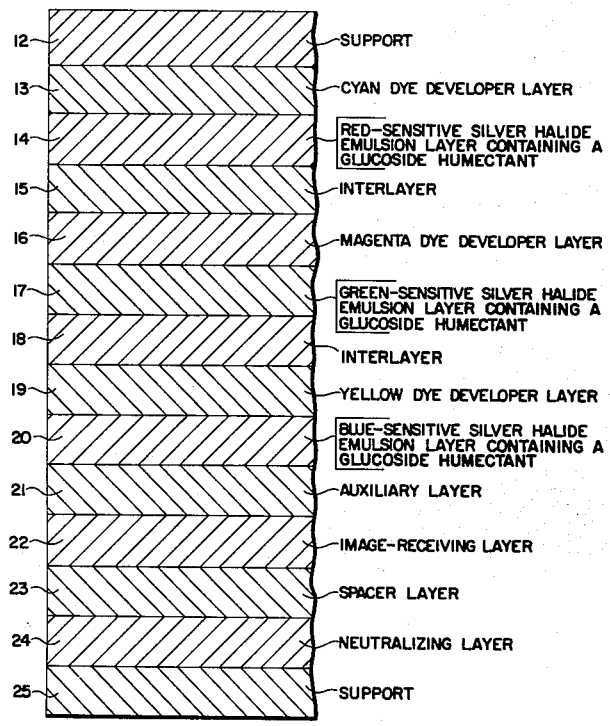

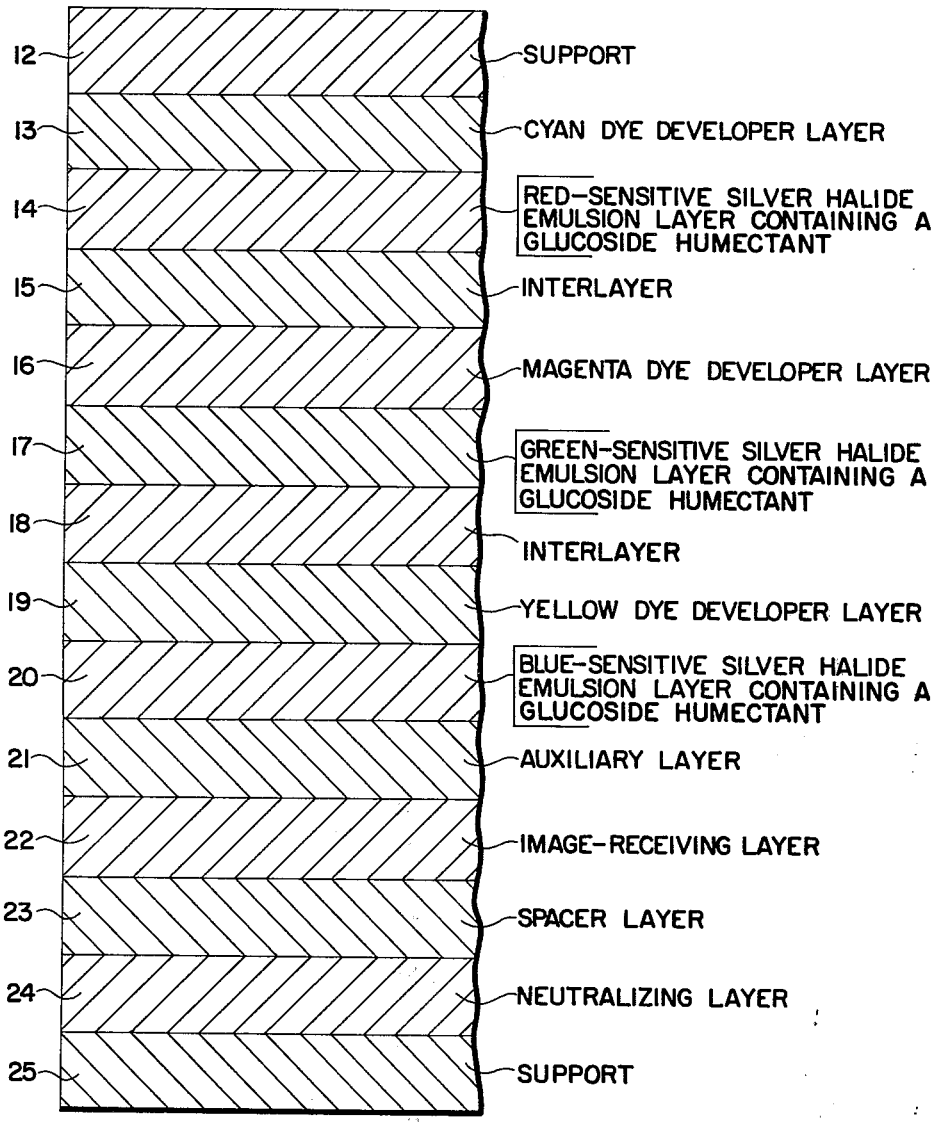
12
SUPPORT
13
CYAN DYE DEVELOPER LAYER
14
RED-SENSITIVE SILVER HALIDE EMULSION LAYER CONTAINING A GLUCOSIDE HUMECTANT
15
INTERLAYER
16
MAGENTA DYE DEVELOPER LAYER
17
GREEN-SENSITIVE SILVER HALIDE EMULSION LAYER CONTAINING A GLUCOSIDE HUMECTANT
18
INTERLAYER
19
YELLOW DYE DEVELOPER LAYER
20
BLUE-SENSITIVE SILVER HALIDE EMULSION LAYER CONTAINING A GLUCOSIDE HUMECTANT
21
AUXILIARY LAYER
22
IMAGE-RECEIVING LAYER
23
SPACER LAYER
24
NEUTRALIZING LAYER
25
SUPPORT

GLUCOSIDE HUMECTANT AS SILVER HALIDE EMULSION STABILIZER

CROSS REFERENCE TO RELATED APPLICATION

This application is a continuation-in-part of copending application Ser. No. 303,008 filed Nov. 2, 1972, now abandoned.

BACKGROUND OF THE INVENTION

1. Field of the Invention

This invention relates to the stabilization of photographic elements against fog and, more particularly, to photographic elements and emulsions containing a fog stabilizing amount of a glucoside humectant.

2. Description of the Prior Art

It is well known that the photosensitive emulsions of photographic film units storage tend to "fog", i.e., become spontaneously developable without light exposure. While fog increases with the degree of development of any given emulsion, with constant development conditions fog tends to increase with time and temperature. It is, of course, desirable to have emulsions as stable as possible under conditions of prolonged storage and high temperature, and hence many antifoggants and stabilizers have been proposed in the art as emulsion addenda to protect, to some extent, against the effects of such conditions.

Various polyhydric alcohols have been described as effectively reducing the formation of fog when added to emulsions as antifoggants, for example, the 1,2-glycols of Sonada et al, U.S. Pat. No. 3,650,759, and the polyhydroxy carboxylic acid derivatives of Humphlett, U.S. Pat. No. 3,396,028. It has also been proposed that plasticizers such as glycerine, ethylene glycol and certain other polyols, when added to silver halide emulsions, may result in the reduction of fog, particularly fog caused by mechanical stress. See, for example, Milton et al, U.S. Pat. No. 2,960,404; Albus et al, U.S. Pat. No. 3,042,524; and Nishio et al, U.S. Pat. No. 3,520,694.

Humectants such as glycerine and alpha methyl glucoside have been described, for example, in Farney, U.S. Pat. No. 3,666,460 as being effective in lowering the processing time and/or the amount of processing composition necessary to form an image in a silver diffusion transfer film unit. However, the superior fog-stabilizing effect of a glucoside humectant in a film unit for forming color images by diffusion transfer has heretofore been unknown and unanticipated.

BRIEF SUMMARY OF THE INVENTION

The present invention is directed to a photographic film unit, particularly a film unit suitable for use in color diffusion transfer systems, wherein one or more layers contains an amount of a glucoside humectant, such as alpha methyl glucoside, which is effective to stabilize the emulsion(s) of the film unit against fog. The presence of the glucoside provides greater $D_{max}$ stability upon prolonged storage than that shown by film units which do not contain the glucoside or which contain prior art polyhydroxyl compounds such as glycerine.

BRIEF DESCRIPTION OF THE DRAWING

The FIGURE is an enlarged, fragmentary, diagrammatic sectional view of a film unit contemplated by this invention.

DETAILED DESCRIPTION OF THE PREFERRED EMBODIMENT

As noted above, the present invention has special applicability to multicolor diffusion transfer film units and, for convenience, the following illustrative description will be in connection with such film units, although the invention in its broadest aspects is not limited thereto.

Various diffusion transfer for forming color images have heretofore been disclosed in the art. Generally speacking, such systems rely for color image formation upon a differential in mobility or solubility of a dye image-providing material obtained as a function of development so as to provide an imagewise distribution of such material which is more diffusible and which is, therefore, selectively transferred, at least in part, by diffusion, to a superposed dyeable stratum to impart thereto the desired color transfer image. The differential in mobility or solubility may, for example, be obtained by a chemical action such as a redox reaction or a coupling reaction.

The dye image-providing materials which may be employed in such processes generally may be characterized as either (1) initially soluble or diffusible in the processing composition but are selectively rendered nondiffusible in an imagewise pattern as a function of development; or (2) initially insoluble or nondiffusible in the processing composition but which are selectively rendered diffusible in an imagewise pattern as a function of development. These materials may be complete dyes or dye intermediates, e.g., color couplers.

As examples of initially soluble or diffusible materials and their application in color diffusion transfer, mention may be made of those disclosed, for example, in U.S. Pat. Nos. 2,647,049; 2,661,293; 2,698,244; 2,698,798; 2,802,735; 2,744,668; and 2,983,606. As examples of initially nondiffusible materials and their use in color transfer systems, mention may be made of the materials and systems disclosed in U.S. Pat. Nos. 3,443,939; 3,443,940; 3,227,550; 3,227,551; 3,227,552; 3,227,554; 3,243,294; and 3,445,228.

In any of these systems, multicolor images are obtained by employing a film unit containing at least two selectively sensitized silver halide layers each having associated therewith a dye image-providing material exhibiting desired spectral absorption characteristics. The most commonly employed elements of this type are the so-called tripack structures employing a blue-, a green- and a red-sensitive silver halide layer having associated therewith, respectively, a yellow, a magenta and a cyan dye image-providing material.

A particularly useful system for forming color images by diffusion transfer is that described in U.S. Pat. No. 2,983,606, employing dye developers (dyes which are also silver halide developing agents) as the dye image-providing materials. In such systems, a photosensitive element comprising at least one silver halide layer having a dye developer associated therewith (in the same or in an adjacent layer) is developed by applying an aqueous alkaline processing composition. Exposed and developable silver halide is developed by the dye developer which in turn becomes oxidized to provide an oxidation product which is appreciably less diffusible than the unoxidized dye developer, thereby providing an imagewise distribution of diffusible dye developer in terms of undeveloped areas of the silver halide layer, which imagewise distribution is then transferred, at least in part, by diffusion, to a dyeable stratum to impart thereto a positive dye transfer image. Multicolor images may be obtained with a photosensitive element having two or more selectively sensitized silver halide layers and associated dye developers, a tripack structure of the type described above and in various patents including the aforementioned U.S. Pat. No. 2,983,606 being especially suitable for accurate color recordation of the original subject matter.

In color diffusion transfer systems of the foregoing description, color images are obtained by exposing a photosensitive element or "negative component" comprising at least a light-sensitive layer, e.g., a gelatino silver halide emulsion layer, having a dye image-providing material associated therewith in the same or in an adjacent layer, to form a developable image; developing this exposed element with a processing composition to form an imagewise distribution of a soluble and diffusible image-providing material; and transferring this imagewise distribution, at least in part, by diffusion, to a superposed receiving element or "positive component" comprising at least a dyeable stratum to impart to this stratum a color transfer image. The negative and positive components may be separate elements which are brought together during processing and thereafter either retained together as the final print or separated following image formation; or they may together comprise a unitary structure, e.g., integral negative-positive film units wherein the negative and positive components are laminated and/or otherwise physically retained together at least prior to image formation.

While the present invention is applicable both to those systems wherein the dyeable stratum is contained on a separate element and to those systems wherein the dyeable stratum and the photosensitive strata comprise a unitary structure, of particular interest are those integral negative-positive film units adapted for forming color transfer images viewable without separation, i.e., wherein the positive component need not be separated from the negative component for viewing purposes. Generally, such film units comprise a plurality of essential layers including a negative component comprising at least one light-sensitive silver halide and associated dye image-providing material and a positive component comprising dyeable stratum. These components may be laminated together or otherwise secured together in physical juxtaposition as a single structure. Film units intended to provide multicolor two or more selectively sensitized silver halide layers each having associated therewith an appropriate dye image-providing material exhibiting desired spectral absorption characteristics. As was heretofore mentioned, the most commonly employed negative components for forming multicolor images are of the tripack structure containing a blue-, a green- and a red-sensitive silver halide layer having associated therewith in the same or in a contiguous layer a yellow, a magenta and a cyan dye image-providing material, respectively. Interlayers or spacer layers may if desired be provided between the respective silver halide layers and associated dye imageproviding materials. In addition to the aforementioned essential layers, such film units further include means for providing a reflecting layer between the dyeable stratum and the negative component in order to mask effectively the silver image or images formed as a function of development of the silver halide layer or layers and any remaining associated dye image-providing material and to provide a background for viewing the color image formed in the dyeable stratum, without separation, by reflected light. This reflecting layer may comprise a preformed layer of a reflecting agent included in the essential layers of the film unit or the reflecting agent may be provided after photoexposure, e.g., by including the reflecting agent in the processing composition. These essential layers are preferably contained on a transparent dimensionally stable layer or support member positioned closest to the dyeable stratum so that the resulting transfer image is viewable through this transparent layer. Most preferably, another dimensionally stable layer which may be transparent or opague is positioned on the opposed surface of the essential layers so that the aforementioned essential layers are sandwiched or confined between a pair of dimensionally stable layers or support members, at least one of which is transparent to permit viewing therethrough of a color transfer image obtained as a function of development of the exposed film unit in the accordance with the known color diffusion transfer system such as will be detailed hereinafter. In a particularly preferred form, such film units are employed in conjunction with a rupturable container of known description containing the requisite processing composition and adapted upon application of pressure of applying its contents to develop the exposed film unit, e.g., by applying the processing composition in a substantially uniform layer between the dyeable stratum and the negative component. It will be appreciated that the film unit may optionally contain other layers performing specific desired functions, e.g., spacer layers, etc.

Opacifying means be provided on either side of the negative component so that the film unit may be processed in the light to provide the desired color transfer image. In a particularly useful embodiment, such opacifying means comprise an opaque dimensionally stable layer or support member positioned on the free or outer surface of the negative component, i.e., on the surface of the film unit opposed from the positive component containing the dyeable stratum to prevent photoexposure by actinic light incident thereon from this side of the film unit and an opacifying agent applied during development between the dyeable stratum and the negative component, e.g., by including the opacifying agent in a developing composition so applied, in order to prevent further exposure (fogging) by actinic light incident thereon from the other side of the film unit when the thus exposed film unit is developed in the light. The last-mentioned opacifying agent may comprise the aforementioned reflecting agent which masks the negative component and provides the requisite background for viewing the transfer image formed thereover. Where this reflecting agent does not by itself provide the requisite opacity it may be employed in combination with an additional opacifying agent in order to prevent further exposure of the light-sensitive silver halide layer or layers by actinic light incident thereon. A preferred opacification system to be contained in the processing composition is described in, for example, U.S. Pat. No. 3,647,437.

In lieu of having the reflecting pigment contained in the processing composition, the reflecting pigment needed to mask the photosensitive strata and to provide the requisite background for viewing the color transfer image formed in the receiving layer may be contained initially in whole or in part as a preformed layer in the film unit, as that disclosed in U.S. Pat. Nos.

3,615,421 and 3,620,724. The reflecting pigment may be generated in situ as is disclosed in U.S. Pat. Nos. 3,647,434 and 3,647,435.

As examples of such integral negative-positive film units for preparing color transfer images viewable without separation as reflection prints, mention may be made of those described and claimed in U.S. Pat. Nos. 3,415,644; 3,415,645; 3,415,646; 3,473,925; 3,573,043; 3,576,625; 3,573,042; 3,594,164; and 3,594,165.

In the various color diffusion transfer systems which have previously been described and which employ an aqueous alkaline processing fluid, it is well known to employ an acid-containing layer to lower the environmental pH following substantial dye transfer in order to increase the image stability and/or to adjust the pH from a first pH at which the imaging dyes are diffusible to a second (lower) pH at which they are not. For example, U.S. Pat. No. 3,362,819 discloses systems wherein the desired pH reduction may be effected by providing a polymeric acid layer adjacent the dyeable stratum. As examples of other useful neutralizing layers, in addition to those disclosed in the aforementioned U.S. Pat. No. 3,362,819, mention may be made of those disclosed in U.S. Pat. Nos. 3,756,815; 3,765,885; 3,754,910;; and application Ser. No. 231,835 of Sahatjian et al, filed Mar. 6, 1972, etc.

An inert interlayer or spacer layer may be and is preferably disposed between the polymeric acid layer and the dyeable stratum in order to control the pH reduction so that it is not premature and hence interferes with the development process, e.g., to "time" control the pH reduction. Suitable spacer or "timer" layers for this purpose are described with particularity in Pat. No. 3,362,819 and in others, including U.S. Pat. Nos. 3,419,389; 3,421,893; 3,433,633; 3,455,686; and 3,575,701.

While the acid layer and associated spacer layer are preferably contained in the receiving element employed in systems wherein the dyeable stratum and photosensitive strata are contained on separate elements, e.g., between the support for the receiving element and the dyeable stratum; or associated with the dyeable stratum in those integral film units, e.g., on the side of the dyeable stratum opposed from the negative component, they may, if desired, be associated with the photosensitive strata, as is disclosed, for example, in U.S. Pat. Nos. 3,362,821 and 3,573,043.

In film units such as those described in the aforementioned U.S. Pat. Nos. 3,594,164 and 3,594,165, they also may be contained on the spreader sheet employed to facilitate application of the processing fluid.

In accordance with this invention, at least one layer of the above-described film unit, and preferably all of the silver halide emulsion layers of the film unit, contain an amount of a glucoside humectant which is effective to stabilize the emulsion or emulsions of the film unit against fog, particularly during the storage of the film unit. In other words, the present invention is directed to the use of such glucosides as antifoggants and emulsion stabilizers in diffusion transfer film units.

As used herein, the term "glucoside" denotes the reaction product of an alcohol and glucose (which product is sometimes characterized as an acetal). As examples of such glucosides, mention may be made of alpha methyl glucoside, beta methyl glucoside, alpha ethyl glucoside, etc. Of course, the selected glucoside should be photographically innocuous in the system, i.e., it should be compatible with the other components of the film unit and the layer in which it is incorporated, and not adversely affect the light-sensitive emulsion or the processing of a developable image produced by photoexposure thereof.

It is contemplated that the glucoside humectant may be incorporated in any of the layers of a film unit which also contains a silver halide emulsion layer. It has been found that the retention of moisture within the film unit environment as the result of the incorporation of the glucoside humectant contributes to the reduction of fog in the emulsion during storage in accordance with this invention. Accordingly, any site in the film unit wherein this moisture retention is accomplished is within the scope of the invention, e.g., a dye layer, an interlayer, an overcoat layer, etc. As previously stated, the glucoside is preferably added directly to the silver emulsion layer(s).

The amount of glucoside humectant needed will vary according to the structure and character of the film unit and the developing composition employed as well as the processing conditions. Generally, between about 5 and 100 mgs./ft.$^2$ of glucoside may be employed per film unit or about 5 to 50 mgs./ft.$^2$ per silver halide emulsion layer. Particularly good results have been obtained when about 15 to 35 mgs./ft.$^2$ of glucoside is present in each emulsion layer; however; any amount found to be effective in stabilizing the emulsion against fog is contemplated as suitable in the practice of the invention.

The Figure shows a preferred integral positive-negative film unit of the invention which may comprise a layer 13 of cyan dye developer, red-sensitive silver halide emulsion layer 14 containing a glucoside humectant, interlayer 15, a layer of magenta dye developer 16, green-sensitive silver halide emulsion layer 17 containing a glucoside humectant, interlayer 18, yellow dye developer layer 19, blue-sensitive silver halide emulsion layer 20 containing a glucoside humectant, auxiliary layer 21, image-receiving layer or dyeable stratum 22, spacer layer 23, and a pH-reducing or neutralizing layer 24. Layers 13 to 21 comprise the negative component and layers 22 to 24 comprise the positive component. These layers are shown to be confined between a dimensionally stable layer or support member 12 which is preferably opaque so as to permit development in the light and dimensionally stable layer or support member 25 which is effectively transparent to permit viewing of a color transfer image formed as a function of development in receiving layer or dyeable stratum 22.

Layers 12 and 25 are preferably dimensionally stable liquid-impermeable layers which when taken together may possess a processing composition solvent vapor permeability sufficient to effect, subsequent to substantial transfer image formation and prior to any substantial environmental image degradation to which the resulting image may be prone, osmotic transpiration of processing composition solvent in a quantity effective to decrease the solvent from a first concentration at which the color-providing material is diffusible to a second concentration at which it is not. Although these layers may possess a vapor transmission rate of 1 or less gms./24 hrs./100 in.$^2$/mil., they preferably possess a vapor transmission rate for the processing composition solvent averaging not less than about 100 gms./24 hrs./100 in.$^2$/mil., most preferably in terms of the preferred solvent, water, a vapor transmission rate averaging in excess of about 300 gms. of water/24 hrs./100 in.$^2$/mil., and may advantageously comprise a microporous polymeric film possessing a pore distribution which does not unduly interfere with the dimensional stability of the layers or, where required, the optical characteristics of such layers. As examples of useful materials of this nature, mention may be made of those having the aforementioned characteristics and which are derived from ethylene glycol terephthalic acid; vinyl chloride polymers; polyvinyl acetate; cellulose derivatives, etc. As heretofore noted, layer 12 is of sufficient opacity to prevent fogging from occurring by light passing therethrough, and layer 26 is transparent to permit photoexposure and for viewing of a transfer image formed on receiving layer 23.

The silver halide layers preferably comprise photosensitive silver halide, e.g., silver chloride, bormide or iodide or mixed silver halides such as silver iodobromide or chloroiodobromide dispersed in a suitable colloidal binder such as gelatin and such layers may typically be on the order of 0.6 to 6 microns in thickness. As previously indicated, the glucoside of the invention may be present in one or more of the silver halide emulsion layers and is preferably present in each emulsion layer. It will be appreciated that the silver halide layers may and in fact generally do contain other adjuncts, e.g., chemical sensitizers such as are disclosed in U.S. Pat. Nos. 1,574,944; 1,623,499; 2,410,689; 2,597,856; 2,597,915; 2,487,850; 2,518,698; 2,521,926; etc.; as well as other additives performing specific desired functions, e.g., coating aids, hardeners, viscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

The respective dye developers, which may be any of those heretofore known in the art and disclosed, for example in U.S. Pat. No. 2,983,606, etc., are preferably dispersed in an aqueous alkaline permeable polymeric binder, e.g., gelatin as a layer from about 1 to 7 microns in thickness.

Interlayers 15, 18 and 21 may comprise an alkaline permeable polymeric material such as gelatin and may be on the order of from about 1 to 5 microns in thickness. As examples of other materials for forming these interlayers, mention may be made of those disclosed in U.S. Pat. Nos. 3,421,892; 3,575,701; 3,615,422; and 3,625,685. These interlayers may also contain additional reagents performing specific functions and the various ingredients necessary for development may also be contained initially in such layers in lieu of being present initially in the processing composition, in which event the desired developing composition is obtained by contacting such layers with the solvent for forming the processing composition, which solvent may include the other necessary ingredients dissolved therein.

The image-receiving layer may be on the order of 0.25 to 0.4 mil. in thickness. Typical materials heretofore employed for this layer include dyeable polymers such as nylon, e.g., N-methoxymethyl poly-hexamethylene adipamide; partially hydrolyzed polyvinyl acetate; polyvinyl alcohol with or without plasticizers; cellulose acetate with filler as, for example, one-half cellulose acetate and one-half oleic acid; gelatin; polyvinyl alcohol or gelatin containing a dye mordant such as poly-4-vinylpyridine, etc. Such receiving layers may, if desired, contain suitable mordants, e.g., any of the conventional mordant materials for acid dyes such as those disclosed, for example, in the aforementioned U.S. Pat. No. 3,227,550; as well as other additives such as ultraviolet absorbers, pH-reducing substances, etc. It may also contain specific reagents performing desired functions, e.g., a development restrainer, as disclosed, for example, in U.S. Pat. No. 3,265,498.

The spacer or timing layer may be on the order of 0.1 to 0.7 mil. thick. Materials heretofore used for this purpose include polymers which exhibit inverse temperature-dependent permeability to alkali, e.g., as disclosed in U.S. Pat. No. 3,445,686. Materials previously employed for this layer include polyvinyl alcohol, cyanoethylated polyvinyl alcohol, hydroxypropyl polyvinyl alcohol, polyvinyl methyl ether, polyethylene oxide, polyvinyl oxazolidinone, hydroxypropyl methyl cellulose, partial acetals of polyvinyl alcohol such as partial polyvinyl butyral and partial polyvinyl propional, polyvinyl amides such as polyacrylamide, etc. One preferred timing layer comprises a graft polymer of the type described in U.S. Pat. No. 3,575,701.

The neutralizing layer may be on the order of 0.3 to 1.5 mil. in thickness. The neutralizing layer will preferably contain less than 2000 mgs. of solids per square foot of surface area. It may also contain other reagents performing specific desired functions, e.g., stabilizers, small amounts of a cross-linking agent such as gelatin, UV absorbers, etc.

The implementation of this invention may be more readily understood if further description is made in the context of specific examples, which are presented for purposes of illustration only and are not intended to limit the invention to the details set forth therein.

EXAMPLE I

A series of multicolor diffusion transfer film units of the type shown in the Figure were prepared having approximately 32 mgs./ft.$^2$ of alpha methyl glucoside in each of the red- and green-sensitive silver halide emulsions and approximately 16 mgs./ft.$^2$ in the blue-sensitive silver halide emulsion. The glucoside was dispersed in the liquid emulsion prior to coating the layers. A second series of film units, identical to those just described except for the absence of the alpha methyl glucoside in the emulsion layers, were also prepared at the same time to serve as controls.

It should be recognized that further specific details of the components of the above film units are not important for the purposes of the present illustration since these components were maintained constant throughout the comparison. The only essential difference in the film units tested was the presence or absence of the indicated amounts of alpha methyl glucoside. While the exact amounts of materials actually employed may differ to a certain extent from that outlined below, the structure and composition of the film units employed were essentially as follows, with the numbers of the layers corresponding with those in the FIG.:

The negative component was prepared, for example, by coating, in succession, on a gelatin subbed, opaque film base support 12, the following layers:

13. a layer of cyan dye developer dispersed in gelatin and coated at a coverage of about 100 mgs./ft.$^2$ of dye and about 80 mgs./ft.$^2$ of gelatin;

14. a red-sensitive gelatino silver iodobromide emulsion coated at a coverage of about 140 mgs./ft.$^2$ of silver and about 70 mgs./ft.$^2$ of gelatin;

15. a layer of a 60-30-4-6 copolymer of butylacrylate, diacetone acrylamide, styrene and methacrylic acid and polyarylamide coated at a coverage of about 150 mgs./ft.$^2$ of the copolymer and about 5 mgs./ft.$^2$ of polyacrylamide;

16. a layer of magenta dye developer dispersed in gelatin and coated at a coverage of about 100 mgs./ft.$^2$ of dye and about 100 mgs./ft.$^2$ of gelatin;

17. a green-sensitive gelatino silver iodobromide emulsion coated at a coverage of about 100 mgs./ft.$^2$ of silver and about 50 mgs./ft.$^2$ of gelatin;

18. a layer containing the copolymer referred to above in layer 3 and polyacrylamide coated at a coverage of about 100 mgs./ft.$^2$ of copolymer and about 12 mgs./ft.$^2$ of polyacrylamide, and about 10 mgs./ft.$^2$ of succindialdehyde;

19. a layer of yellow dye developer dispersed in gelatin and coated at a coverage of about 70 mgs./ft.$^2$ of dye and about 56 mgs./ft.$^2$ of gelatin;

20. a blue-sensitive gelatino silver iodobromide emulsion layer including the auxiliary developer 4'- methylphenylhydroquinone coated at a coverage of about 120 mgs./ft.$^2$ of silver, about 60 mgs./ft.$^2$ of gelatin and about 30 mgs./ft.$^2$ of auxiliary developer; and

21. a layer of gelatin coated at a coverage of about 50 mgs./ft.$^2$ of gelatin.

The three dye developers employed above were the following:

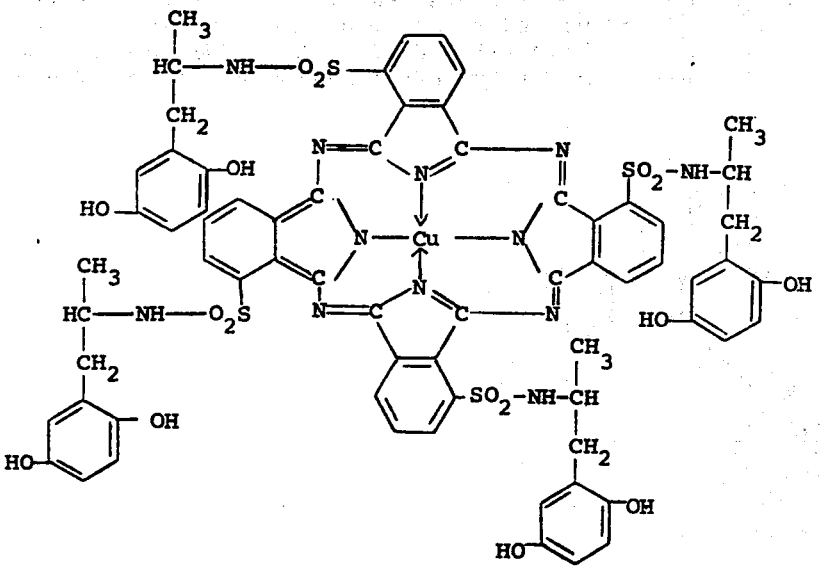

a cyan dye developer;

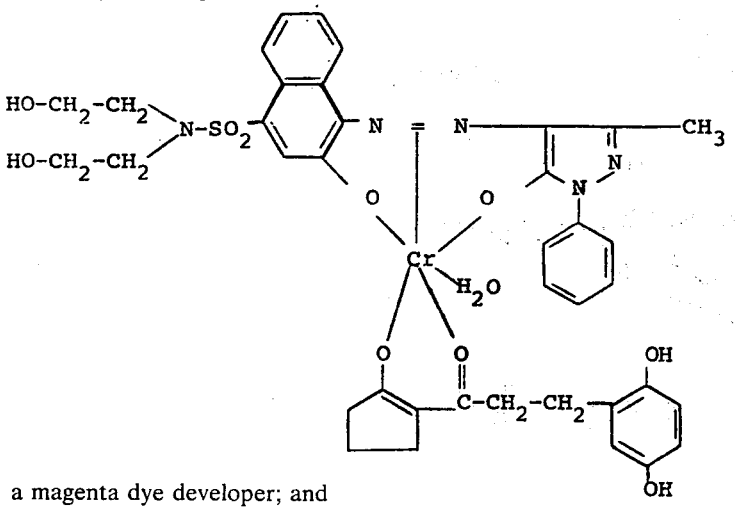

a magenta dye developer; and

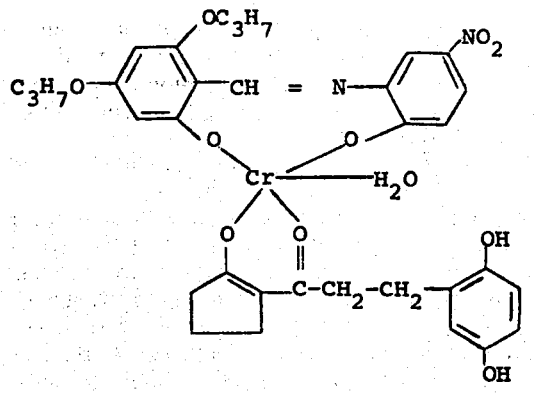

a yellow dye developer.

The coated surface of a gelatin sub-coated transparent film base support 25 was coated, in succession, with the following illustrative layers, to form the positive component:

22. a polymeric acid neutralizing layer prepared by containing a 7:3 mixture, by weight, of polyethylene/maleic anhydride copolymer and 88 to 90% hydrolyzed polyvinyl acetate at a coverage of about 1000 mgs./ft.$^2$;

23. a timing layer containing about a 40:1 ratio of a 60-30-4-6 copolymer of butylacrylate, diacetone acrylamide, styrene and methacrylic acid and polyacrylamide at a coverage of about 500 mgs./ft.$^2$;

24. a 2:1 mixture, by weight, of polyvinyl alcohol and poly-4-vinylpyridine, at a coverage of about 400 mgs./ft.$^2$ and including about 20 mgs./ft.$^2$ of a development restrainer, 1-phenyl-5-mercaptotetrazole, to provide a polymeric image-receiving layer containing development restrainer.

The two components were then laminated together to provide the desired integral film unit.

A rupturable container comprising an outer layer of lead foil and an inner liner or layer of polyvinyl chloride retaining an aqueous alkaline processing solution was fixedly mounted on the leading edge of each of the laminates, by pressure-sensitive tapes, interconnecting the respective container and laminates so that, upon application of compression pressure to the container to rupture the container's marginal seal, its contents was distributed between the image-receiving layer and the auxiliary layer.

An illustrative processing composition employed in the rupturable container may comprise the following ingredients:

| | | |
|---|---|---|
| Water | 100 | cc. |
| Potassium hydroxide | 11.2 | gms. |
| Hydroxyethyl cellulose (high viscosity) (commercially available from Hercules Powder Co., Wilmington, Delaware, under the trade name Natrasol 250) | 3.4 | gms. |
| N-phenethyl-α-picolinium bromide | 2.7 | gms. |
| Benzotriazole | 1.15 | gms. |
| Titanium dioxide | 50.0 | gms. |
| (A) | 2.08 | gms. |

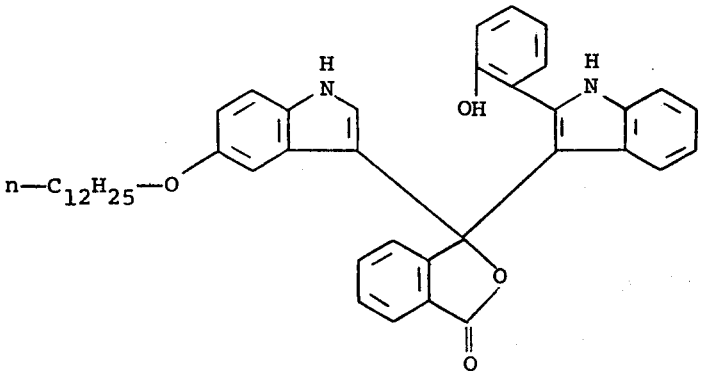

(B) 0.52 gms.

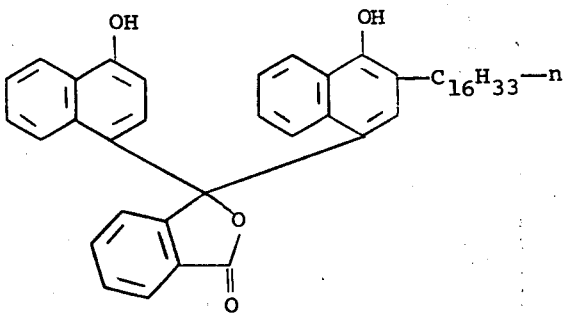

(C) 1.18 gms.

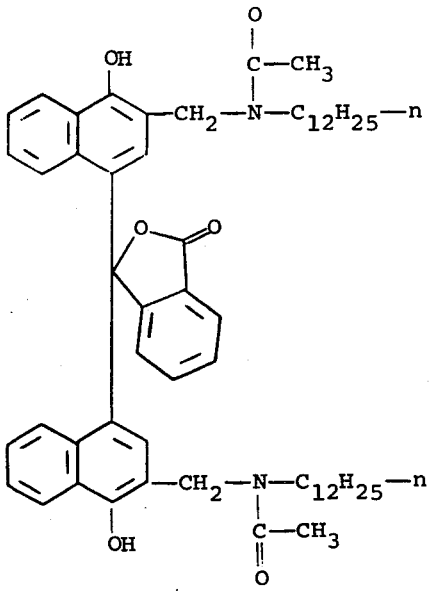

Both test and control film units were stored at room temperature conditions (i.e., 75°F. - 45% RH) in sealed tins. After 1 month, 2 months, 3 months and 8 months had passed, duplicate samples of both test and control film units were exposed to a sensitometric step wedge target and processed under identical conditions at room temperature. The following Table 1 summarizes the maximum transfer densities ($D_{max}$) obtained from each film unit:

TABLE 1

| | $D_{max}$ R | G | B |
|---|---|---|---|
| 1 month storage | | | |
| Test | 1.78 | 2.25 | 1.98 |
| Control | 1.82 | 2.15 | 1.89 |
| Difference | −0.04 | +0.10 | +0.09 |
| 2 months storage | | | |
| Test | 1.77 | 2.28 | 2.01 |
| Control | 1.80 | 2.14 | 1.89 |
| Difference | −0.03 | +0.14 | +0.12 |
| 3 months storage | | | |
| Test | 1.78 | 2.31 | 2.05 |
| Control | 1.69 | 2.09 | 1.85 |
| Difference | +0.09 | +0.22 | +0.20 |
| 8 months storage | | | |
| Test | 1.80 | 2.26 | 1.98 |
| Control | 1.71 | 1.76 | 1.63 |
| Difference | +0.09 | +0.50 | +0.35 |

It can be seen from Table 1 that $D_{max}$ stability, i.e., resistance to fog during storage, is significantly greater for the test film units having alpha methyl glucoside in the emulsion layers than for the control film units which did not contain the glucoside. It is also noted that green and blue $D_{max}$ are initially higher for the film units with alpha methyl glucoside than for the control film units, indicating some antifoggant activity as well as the above-mentioned fog-stabilization during storage. Improvements in $D_{max}$ stability were also achieved with 14, 14 and 8 mgs./ft.$^2$, and 32, 32 and 0 mgs./ft.$^2$ of alpha methyl glucoside disposed in the red-, green- and blue-sensitive emulsion layers, respectively.

EXAMPLE II

Test and control film units were prepared essentially as described in Example I with about 32 mgs./ft.$^2$ of alpha methyl glucoside in the red- and green-sensitive emulsion layers of the test film units and about 16 mgs./ft.$^2$ in the blue-sensitive emulsion layer. Another series of film units were also prepared with about 15 mgs./ft.$^2$ of glycerine in each of the silver halide emulsion layers, and another series of film units were prepared with about 30 mgs./ft.$^2$ of glycerine in each of the silver halide emulsion layers.

The film units were subjected to a standard accelerated ageing test which consisted of incubating the film units in foil bags at a temperature of 120° F. for 6 days. Thereafter, the film units were cooled to room temperature, exposed to a sensitometric target and processed. Table 2 summarizes the $D_{max}$ values obtained with each film unit. In Table 2, A represents the control film units with no additives, B and C, respectively, represent the film units with 15 mgs./ft.$^2$ and 30 mgs./ft.$^2$ in each emulsion layer, and D represents the film units having the alpha methyl glucoside in the emulsion layers according to the present invention:

Table 2 shows that the film units containing alpha methyl glucoside would be expected to lose significantly less $D_{max}$ upon ageing than either the film units containing no glucoside or the film units containing comparable amounts of glycerine, a polyhydroxyl emulsion additive of the prior art. In fact, it appears from the data of Table 2 that the presence of glycerine in the film units' emulsions would have an adverse effect on $D_{max}$ stability since density loss increases with the amount of glycerine in the film unit.

Since certain changes may be made in the above product and process without departing from the scope of the invention herein involved, it is intended that all matter contained in the above description or shown in the accompanying drawing shall be interpreted as illustrative and not in a limiting sense.

What is claimed is:

1. In a photosensitive element including at least one light-sensitive silver halide emulsion layer, each of which having a dye image-providing material associated therewith, the improvement which comprises including in at least one of the layers of said element an amount of a glucoside humectant effective to stabilize said emulsion against fog during storage; wherein said glucoside humectant is alpha methyl glucoside.

2. An element as defined in claim 1 which includes a red-sensitive gelatino silver halide emulsion having a cyan dye image-providing material associated therewith; a green-sensitive gelatino silver halide emulsion having a magenta dye image-providing material associated therewith and a blue-sensitive gelatino silver halide emulsion having a yellow dye image-providing material associated therewith.

3. An element as defined in claim 2 wherein each of said silver halide emulsions contains an effective amount of said glucoside humectant.

4. An element as defined in claim 1 wherein said glucoside is present at a level of about 5 to 100 mgs./ft.$^2$.

5. An element as defined in claim 4 wherein said glucoside is present in said emulsion layer at a level of about 15 to 35 mgs./ft.$^2$.

6. An element as defined in claim 1 which includes a positive component including at least a dyeable stratum.

7. A photographic film unit which comprises, in combination:

a photosensitive element having a diffusion transfer image-receiving element affixed to at least one edge thereof, said photosensitive element comprising a support carrying:

a. a red-sensitive silver halide emulsion having associated therewith a cyan dye developer;

b. a green-sensitive silver halide emulsion having associated therewith a magenta dye developer;

c. a blue-sensitive silver halide emulsion having associated therewith a yellow dye developer; at least

TABLE 2

| | FILM UNIT A (Control) | | | B (15 mgs./ft.$^2$ glycerine) | | | C (30 mgs./ft.$^2$ glycerine) | | | D (alpha methyl glucoside) | | |
|---|---|---|---|---|---|---|---|---|---|---|---|---|
| | R | G | B | R | G | B | R | G | B | R | G | B |
| $D_{max}$ Before Incubation | 1.885 | 1.960 | 2.025 | 1.875 | 1.930 | 2.095 | 1.905 | 1.965 | 2.075 | 1.935 | 2.000 | 2.175 |
| $D_{max}$ After Incubation | 1.775 | 1.875 | 1.840 | 1.730 | 1.795 | 1.775 | 1.425 | 1.455 | 1.430 | 1.885 | 1.940 | 1.980 |
| Change in $D_{max}$ | −.110 | −.085 | −.185 | −.145 | −.135 | −.320 | −.480 | −.510 | −.645 | −.050 | −.060 | −.195 |

one of said silver halide emulsions having associated therewith an amount of a glucoside humectant effective to stabilize said emulsion against fog during storage wherein said glucoside humectant is alpha methyl glucoside;

said diffusion transfer image-receiving element comprising a support layer carrying:

an alkaline processing composition permeable and dyeable layer wherein said photosensitive and said image-receiving elements are adapted to be superposed, the support layers of each comprising the extremities of the superposed structure.

8. The product as defined in claim 7 wherein said glucoside humectant is disposed in each of said silver halide emulsion layers.

9. The product as defined in claim 7 including a rupturable container retaining an aqueous alkaline processing composition affixed one edge of said photosensitive and said image-receiving elements and adapted upon rupture to distribute its contents intermediate said superposed photosensitive and said image-receiving elements.

10. The product as defined in claim 9 wherein said image-receiving element support layer is transparent.

11. The product as defined in claim 10 wherein said photographic film unit comprises a composite structure comprising said photosensitive element and said image-receiving element permanently affixed each to the other in superposed relationship, the support layers of each of said elements comprising the extremities of said composite structure.

12. A process for forming photographic images which comprises, in combination, the steps of:

a. exposing a photographic film unit which comprises a plurality of layers including at least a first photosensitive silver halide emulsion layer having associated therewith diffusion transfer dye image-providing material and a glucoside humectant in an amount effective to stabilize said emulsion against fog during storage wherein said glucoside humectant is alpha methyl glucoside; and a diffusion transfer process image-receiving layer adapted to receive solubilized image-forming material diffusing thereto;

b. contacting said photosensitive silver halide emulsion with an aqueous alkaline processing composition;

c. effecting thereby substantial development of said silver halide emulsion;

d. forming thereby an imagewise distribution of mobile image-forming material as a function of the point-to-point degree of emulsion exposure; and e. transferring by diffusion at least a portion of said imagewise distribution of mobile image-forming material to said layer adapted to receive said material to provide thereto an image in terms of said imagewise distribution.

* * * * *